United States Patent [19]

childers et al.

[11] 3,931,782

[45] Jan. 13, 1976

[54] MOORING METHOD FOR DEPLOYMENT AND RETRIEVING OF MOORING LINES

[75] Inventors: Mark A. childers; Enoch L. Dawkins, both of New Orleans, La.

[73] Assignee: Ocean Drilling & Exploration Company, New Orleans, La.

[22] Filed: Sept. 26, 1974

[21] Appl. No.: 509,581

[52] U.S. Cl. ..... 114/206 R

[51] Int. Cl.[2] ..... B63B 21/50

[58] Field of Search ..... 114/206 R, 230, 221 R, 114/50, .5 D, 235 B, 235 F, 235 R, 210, 43.5; 24/241 PS, 279; 294/83 AE, 84, 82 R, 66 R

[56] References Cited

UNITED STATES PATENTS

| | | | |
|---|---|---|---|
| 3,130,703 | 4/1964 | Thompson | 114/206 R |
| 3,151,594 | 10/1964 | Collipp | 114/206 R |
| 3,319,426 | 5/1967 | Slonczewski | 61/72.3 |

*Primary Examiner*—George E. A. Halvosa
*Assistant Examiner*—Stuart M. Goldstein
*Attorney, Agent, or Firm*—Michael P. Breston

[57] ABSTRACT

This invention relates to a mooring method and system and includes a process of deploying and retrieving anchors, each anchor being attached by a long mooring line to a floating moored structure.

For deploying an anchor at the end of a very long mooring line, a work boat reels out its service line. A remote release hook is attached to the end of the service line. A short pendant line preferably couples the hook to the anchor. A small buoy is desirably attached to the pendant line to maintain it erect. After deploying the mooring line and setting the anchor, the hook is remote released to thereby free the service line from the short pendant line.

For retrieving an anchor, a submerged remote-operated catch hook is towed at the end of the service line in a direction intersecting the mooring line. The catch normally closes the hook. When the hook's movable catch engages the mooring line, the catch moves away from its normally-closed position, thereby allowing the hook to capture the mooring line. After the hook slides down sufficiently on the mooring line, a pull is exerted on the service line to unseat the anchor. The catch is then remote operated to thereby free the mooring line from the hook.

7 Claims, 9 Drawing Figures

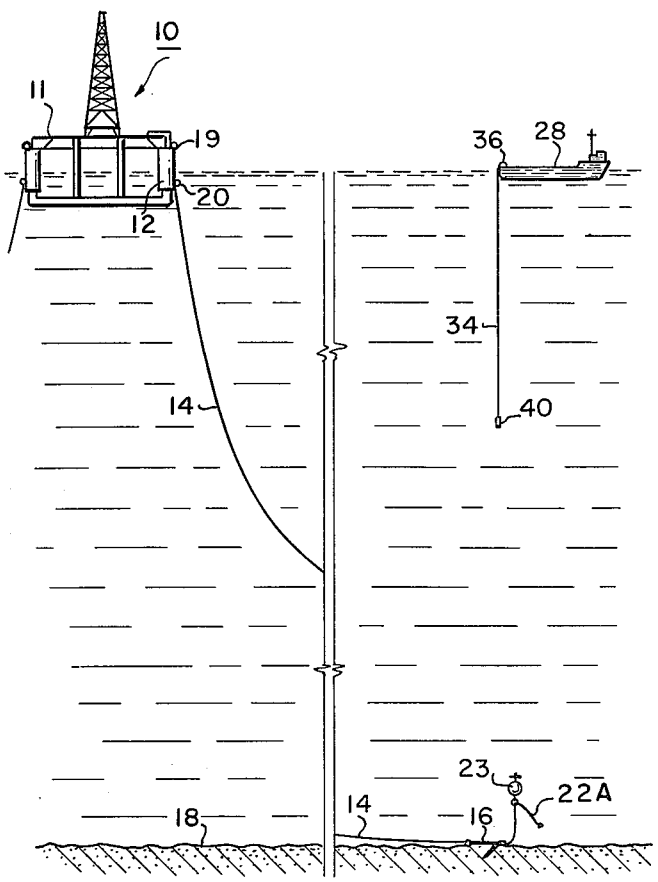
FIG. 1
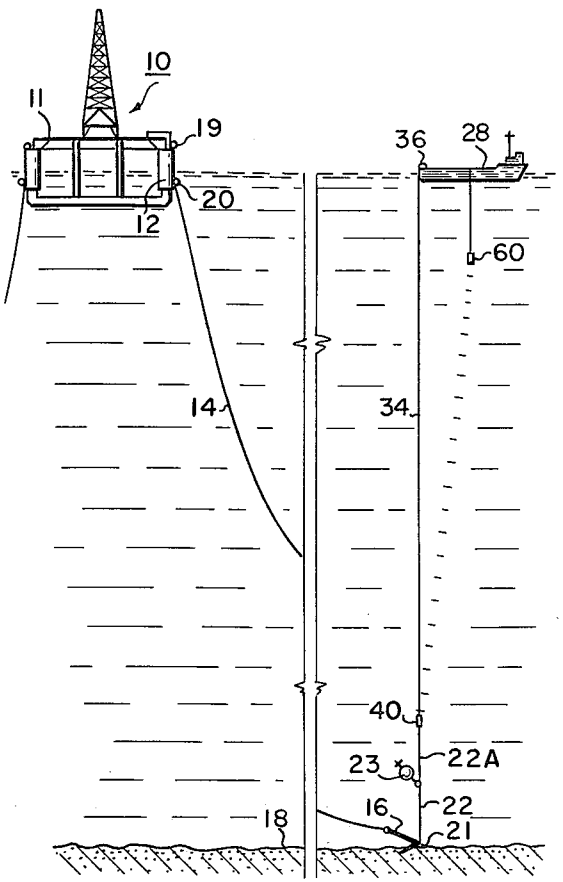
FIG. 2.
FIG. 3.

MOORING LINE
14
WORK BOAT
28
PATH OF BOAT
84
HOOK
70
ANCHOR
16
WORK BOAT
HOOK

MOORING METHOD FOR DEPLOYMENT AND RETRIEVING OF MOORING LINES

REFERENCE TO RELATED APPLICATIONS

This application is related to application Ser. No. 509,573, filed on Sept. 26, 1974, assigned to the same assignee, which describes a remote-operated catch hook that can be used in the retrieval phase of this invention. This application is also related to application Ser. No. 522,395, filed on Nov. 11, 1974, also assigned to the same assignee, which describes a non-remote operated catch hook which could also, but less desirably, be used in the retrieval phase of this invention.

BACKGROUND OF THE INVENTION

Marine structures are frequently moored to the sea bottom by anchors connected to the structure by a spread of mooring lines. Drilling rigs are illustrative of such marine structures for which the mooring system is both critical and very expensive. With the greater emphasis on offshore exploration, drilling rigs will now be required to operate within water depths of up to and beyond 3,000 feet and in very severe environments. The mooring system is designed to maintain the rig within certain horizontal limits from the center line of the well. Dynamic anchors are presently employed because they increase their holding power with horizontal pull provided by the rig, and because such anchors become deeply buried in soft bottoms.

To prevent an uplifting force from becoming exerted on and unseating the anchor, a sufficient length of mooring line must be deployed, considerably greater than the water depth. Maximum holding power is obtained when the fluke angle is set at approximately 30° for sandy bottoms and 50° for muddy bottoms.

Mooring lines consisting of wire rope, chain, or a suitable combination of rope and chain have been successfully used in proportions depending on several factors which include: expected mooring line loads, water depth, handling equipment, storage facilities on board the drilling rig, and types of working boats available for assisting the rig during the deployment and retrieval of the mooring system.

The location of each anchor in a mooring system is marked by a surface or marker buoy connected to the anchor by an anchor cable, known as a pendant line. A submerged assist or spring buoy can also be connected to the pendant line to provide thereto additional buoyancy and protection. In practice, a portion of the pendant line drags over the sea bottom, especially when the surface buoy becomes subjected to strong winds. Abrasion resulting from such dragging can cause a pendant line to prematurely fail.

Various shackles are used to join sections of pendant lines, to attach chain to wire rope, and to attach chain or wire rope to anchors. When long pendant lines are reeled in, the various connecting devices have a tendency to squash and crush the wire rope. After considerable use, such chain links and/or wire rope will rupture, resulting in the loss of one or more pendant lines. The work boat must "chase" the mooring line attached to the anchor whose pendant line fails in order to first locate and then retrieve the lost anchor.

Each pendant line is constructed in a manner similar to a mooring line, above described. A typical pendant cable for very deep water operation, usually will consist of wire rope with a diameter of over 1¾ inches. To hold such a cable erect may require in excess of 20,000 lbs. of net buoyancy.

For a water depth of about 1500 feet, the pendant line may have a length of more than 1800 feet while the subsurface spring buoy may have a structural weight on the order of 13,000 lbs. and a cross-sectional area of about 80 square feet. The marker surface buoy for this particular pendant line is of comparable size to the subsurface spring buoy. For 3,000 feet of water depth, the numerical values would be nearly double of the corresponding numbers given for the 1500 feet water depth. It will be appreciated therefore that the pendant cables and their associated buoys consume a great amount of steel and rig storage space, as well as constitute one additional variable load.

Also, in order to move from one water depth to another, there is a need to make adjustments in the lengths of the pendant lines, all of which is time consuming and expensive. Frequent manipulations of the pendant lines by the crews of the rig and of the work boat contribute to their rapid deterioration. Thus in the Gulf of Mexico, the average life of a pendant line is about three years, while in the North Sea it is considerably less.

It is a primary object of the present invention to eliminate the need (1) for long pendant lines and their associated buoys, thereby considerably reducing the overall cost of rig construction, the cost of anchor deployment, and at the same time increasing the safety of operations, especially in severe environments; (2) for surface and spring buoys; and (3) for making adjustments in the lengths of the pendant lines. It is another object to provide a mooring method which is particularly adapted for severe environments and which reduces the time and difficulty in running mooring lines and anchors.

SUMMARY OF THE INVENTION

Each anchor is deployed using a work boat's service line to the end of which is attached a remote-operated release hook. The anchor is attached to the end of a mooring line. The hook has a catch. The hook portion engages the anchor or a short anchor cable. A small buoy may be attached near the hook to maintain it erect underwater and to subsequently assist in bolstering the anchor on the rig. After deploying the mooring line and setting the anchor, the catch is remotely operated thereby freeing the service line from the short anchor line. The service line is then reeled in and the work boat moved to deploy in a similar manner another mooring line and associated anchor.

The anchor is retrieved by towing a remote-operated catch hook at the end of the service line, in a direction intersecting the mooring line at a point remote from the moored structure. The hook has a catch with a remote releasable lock thereon. When the hook engages the mooring line at a point considerably below the water surface, the catch automatically opens to allow the hook to capture the mooring line. The service line is then moved in the direction of the mooring line and toward the anchor. When the hook slides down to or near the buried anchor, the service line is raised thereby unseating the buried dynamic anchor. When the anchor is already close to being bolstered, the catch is remotely opened. The catch hook is allowed to fall off from the mooring line by slackening the service line.

BRIEF DESCRIPTION OF THE DRAWINGS

FIG. 1 shows an anchor being deployed on a work boat's service line;

FIG. 2 shows the remote operation of the release hook just prior to separating from the anchor;

FIG. 3 is similar to FIG. 2 showing the position of the short anchor cable after decoupling;

DETAILED DESCRIPTION OF THE INVENTION

Figures 4, 5, 6, 7, 8, 9:
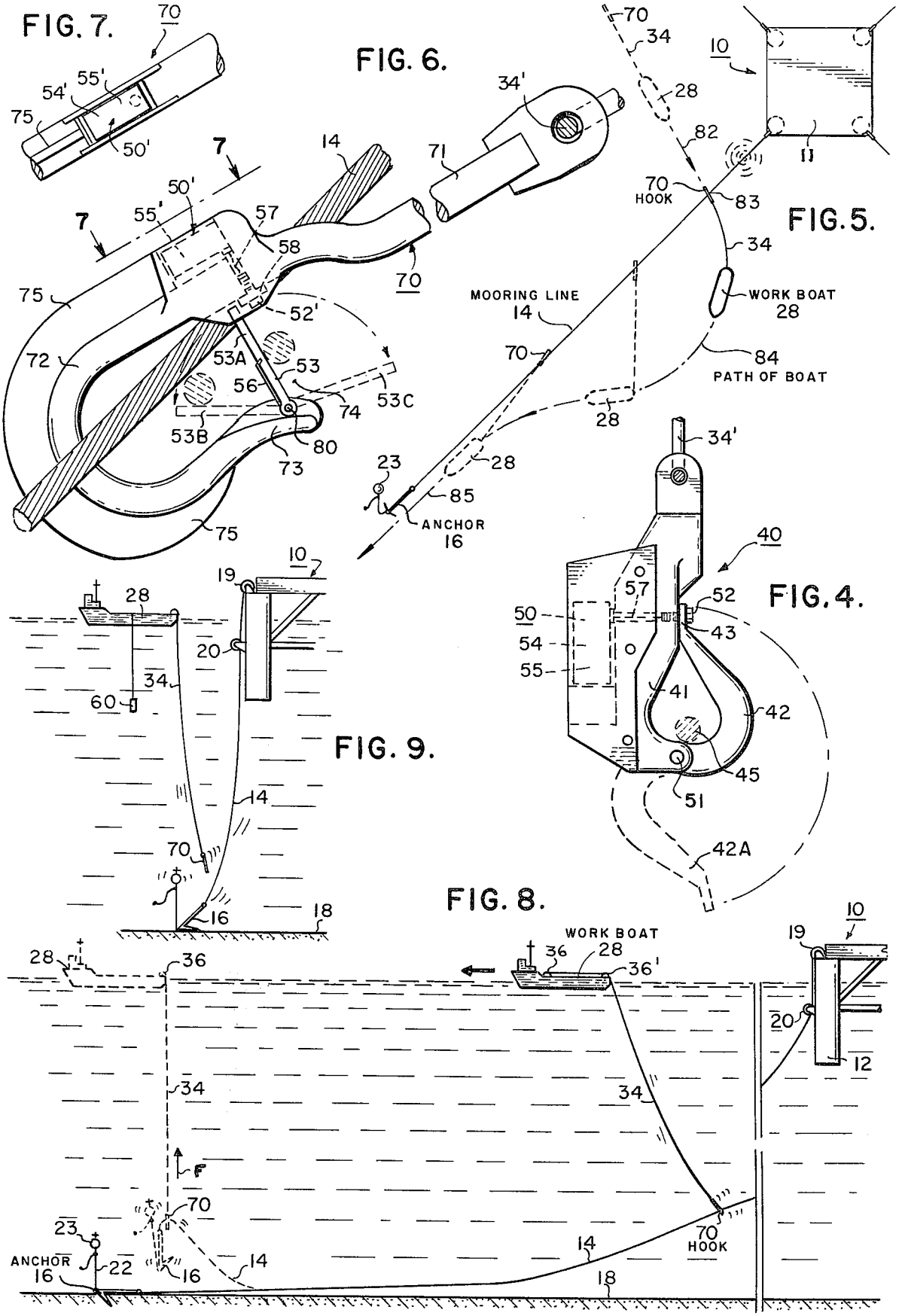
FIG. 4 is a detail view of the release hook.
FIG. 5 illustrates the work boat's movements during anchor retrieval.
FIG. 6 is an enlarged detail view of the catch hook illustrating the three catch positions.
FIG. 7 is a view taken on line 7—7 in FIG. 6.
FIG. 8 illustrates the anchor retrieval process.
FIG. 9 illustrates the decoupling of the release hook.

Throughout the drawings the same numerals are used to designate the same or similar parts.

A floating structure 10, such as a submersible ship, or barge-shaped drilling rig 11, has a chain locker 12 or winch in the case of wire rope, which stores a very long mooring line 14 which may consist of wire, chain or a combination of both. The mooring line is considerably longer than the depth of the body of water to allow for a nearly horizontal pull on the mooring line by the rig which will cause the anchor 16 to bite deep into the sea bottom 18. In the case of chain, mooring line 14 is paid out over a wildcat 19 which is mounted at an elevated position relative to chain locker 12. The mooring line extends below a bottom swivel fairlead 20 positioned at a considerable distance, say 50 feet, below wildcat 19. The crown 21 of anchor 16 is preferably attached to a short (say 100 to 200 feet) anchor line 22 which is coupled to a small buoy 23. Buoy 23 supports the weight of line 22 and assists in bolstering and unbolstering the anchor on and from the rig bolster.

There is provided a remote operated release hook 40 (FIG. 4) which can assume various geometric configurations. The preferred embodiment consists of an L-shaped portion 41, a semi-annular portion 42 followed by a lip portion 43. Portions 41 and 42 pivot about a pin 51. Hook 40 grapples a loop 45 (FIG. 4) on a coupling line 22A (FIG. 1) connected to the short anchor line 22. The dimensions and weight of hook 40 are such that it will retain its structural integrity under maximum pulling load. A service line 34 of a work boat 28 can be connected by a suitable shackle 34' (FIG. 4) to hook 40. The service line 34 can be reeled in and out through a stern roller 36' by winch 36 on the deck of work boat 28.

The release hook 40 is adapted for remote acoustic operation by an acoustic release mechanism, generally designated as 50 (FIG. 4). An explosive bolt 52 or similar such device, serves as a catch and prevents hook portion 42 from rotating clockwise to its open-hook position 42A. The bolt is fired by a coded acoustic signal. A control unit 54 forms part of the release mechanism 50 and consists of an acoustic detector such as a hydrophone, receive and decode electronics, and a battery. Control unit 54 is housed in a pressure case 55. A pair of wires 57 connect control unit 54 with explosive bolt 52.

A surface command unit 60 (FIG. 9), which could be suspended from boat 28, generates an acoustic telemetry signal having a predetermined length and being frequency modulated with an address and fire code.

This acoustic signal travels through the water to become detected by the hydrophone in control unit 54. The hydrophone generates an electric signal which is decoded by the receive electronics. If this signal contains the proper code, the decode electronics, also in unit 54, will generate a release signal which will result in the firing of explosive bolt 52, thus enabling the hook portion 42 to rotate clockwise on pin 51 to its open position 42A.

Underwater acoustic operated explosive bolts 52, the control unit 54, and the command unit 60 are commercially available, for example from the Honeywell Marine Systems Division of Seattle, Wash., and in and by themselves form no part of this invention. It will be appreciated that the remote-operated control unit 54 functions without vulnerable electric cables or other connections, and that the coding permits positive identification of one specific beacon or signal among several such signals in the same area.

The catch hook 70 can assume various geometric configurations. The preferred embodiment is described in detail in said patent application Ser. No. 502,573, and essentially consists of a straight portion 71, an annular portion 72 which is followed by a lip portion 73. The gap or mouth 74 between portions 71 and 73 has a width sufficient to allow hook 70 to grapple any section of mooring line 14. The annular portion 72 is provided with a reinforcing rib 75, conveniently having a rectangular cross-sectional area while the hook itself can have a circular cross-section. The dimensions and weight of hook 70 are such that it will retain its structural integrity under maximum pulling load. Service line 34 can be connected by its suitable shackle 34' to the straight portion 71.

The catch hook 70 is also adapted for remote acoustic operation by an acoustic release mechanism, generally designated as 50' similar to unit 50 previously described. A catch 53 is mounted on a pivot pin 80 in lip 73. A spring 56 biases catch 53 to assume an open hook position 53C. A stop plate 58 locks catch 53 into its close-hook position 53A without preventing catch 53 from rotating counter-clockwise, as viewed in FIG. 6, into a forced open-hook position 53B when the mooring line exerts a downward force on catch 53. After the mooring line 14 becomes captured by hook 70, spring 56 will cause catch 53 to return to its close-hook position 53A. Thus, the mooring line 14 by itself can move through but not out of mouth 74 of hook 70.

A suitable explosive bolt 52', or similar such device, secures stop plate 58 to the hook's straight portion 71 and prevents catch 53 from rotating clockwise. The bolt 52' is again fired by a coded acoustic signal. A control unit 54' (FIG. 7), similar to control unit 54 of release hook 40 (FIG. 4), forms part of the release mechanism 50' and may (not shown) also consist of an acoustic detector such as a hydrophone, receive and decode electronics, and a battery. Control unit 54' is housed in a pressure case 55'. A pair of wires 57 connect the output from control unit 54' with the input to explosive bolt 52'.

The surface command unit 60 (FIG. 2), previously described will generate an acoustic telemetry signal which is coded with an address and fire code. This acoustic signal will also travel through the water to become detected by the hydrophone in control unit 54'. The hydrophone generates an electric signal which is decoded by the control unit's receive electronics. If this signal contains the proper code, the decode electronics forming part of control unit 54′ will generate a release signal which will result in the firing of the explosive bolt 52. Stop plate 58 will now free catch 53 to rotate on its pin 80 and assume its forced or biased open-hook position 53C.

In the anchor deployment operation (FIGS. 1–3), the release hook 40 on the service line 34 is attached to the coupling 22A connected to buoy 23 coupled to short anchor line 22. The anchor is then lowered from the service boat 28 (FIG. 1). After the anchor touches bottom 18 (FIG. 2), the service line 34 is released from the short coupling line 22A by remote operation of release hook 40 with command unit 60. The service line is then reeled in (FIG. 3) and the work boat 28 moved for deployment of another anchor 16, in a similar manner.

In the retrieval operation (FIGS. 5 and 8), hook 70 is towed by the work boat's service line 34 in a direction 82 that intersects or is substantially perpendicular to the vertical plane containing mooring line 14. While being towed at the end of service line 34, hook 70 is submerged at a considerable distance below the water surface, say more than 200 feet. After hook 70 catches the mooring line at point 83, the work boat will swerve toward the general direction of the mooring line as indicated by the dotted line trajectory 84. As the work boat approaches buried anchor 16, it will move in a direction 85 substantially parallel to the mooring line, causing hook 70 to slide down on mooring line 14 until it stops at or near anchor 16. Then the service line is gradually reeled in by winch 36 on work boat 28 (FIG. 8) to thereby exert an uplift force F on the anchor's crown 21 which unseats the anchor from the sea bottom 18.

Thereafter the work boat carries the anchor on its service line 34 toward rig 11 and assists the drilling rig in the retrieval process of the mooring line and of the anchor. To disconnect hook 70 (FIG. 6) from the mooring line, bolt 52 is remotely exploded, as previously described, thereby allowing catch 53 to rotate about its pivot 80 into its biased open-hook position 53C. Service line 34 is then slackened and hook 70 will fall off by itself from the mooring line.

Hook 70 is particularly adapted for very deep waters, say up to and over 3.000 feet, since it will continuously remain on the mooring line while it slides to the bottom 18.

The optional buoy 23 which has to be lowered to about 3,000 feet below the water surface has to be structurally sound to withstand the environmental pressures.

By maintaining erect the short anchor line 22, the release hook 40 will not be dragging on or becoming buried in the sea bottom, else the acoustic signals may fail to operate the explosive bolt 52. Also, the crew can retrieve the end of the sharp coupling line 22A more easily, once the anchor is bolstered.

The advantage of using the embodiment of the release hook such as 40 (FIG. 4) is that conventional hooks can be easily adapted and converted for use with the method of this invention. Thus, a relatively small force produced by explosive bolt 52 enables hook 40 to control very large loads.

With the method of this invention, instead of using a pendant line of approximately 3,000, a short anchor line 22 between 100 and 200 feet can now be employed. In a conventionally moored rig, the total weigth of the pendant lines may be in excess of 200 long tons.

Just the handling and storage of such a great load constitute great wastes of time, money and materials.

Also, with this invention the large surface and spring buoys have been eliminated thereby increasing the above mentioned savings. There will no longer be a need to be concerned, as in the North Sea, that buoys and pendant lines will be lost. When hook 40 is released, the small buoy 23 arrives to the surface and the retrieval of the anchor is facilitated.

Other advantages and modifications will readily suggest themeslves to those skilled in the art and all such are desired to be covered by the claims attached hereto.

What is claimed is:

1. The method of employing a service ship having anchor-deploying equipment for assisting in the mooring to the seabottom of a structure floating in a body of water, said structure having mooring means including a mooring line attached to an anchor, said ship being on the surface of said body of water and having a service line, a hook attached to the service line, said method being characterized by utilizing the following steps:

moving the service ship near said structure, coupling the hook to said mooring means;

progressively releasing the mooring means from the structure into the body of water;

supporting the mooring means with the service line;

moving the ship away from said structure to a desired location;

progressively lowering the service line through the body of water;

burying the anchor in the seabottom;

detaching the hook from the mooring means;

taking in the service line onto the ship; and mooring said structure to said mooring means.

2. The method of claim 1 and employing the service ship to assist in the retrieving of said mooring means by:

moving the service ship near the structure, submerging the hook and a portion of the service line into the body of water;

towing the submerged hook in a direction intersecting the mooring line until the hook catches the mooring line;

gradually swerving the service line in the direction of the mooring line toward the buried anchor;

progressively lowering the service line as the ship moves away from said structure toward said desired location and the hook slides down on the mooring line toward the anchor;

uplifting the hook to unseat the anchor from the seabottom;

progressively taking in the mooring line into the structure;

progressively taking in the service line into the ship while supporting the mooring means with the service line;

moving the ship toward the structure; and releasing the hook from the mooring line.

3. The method of claim 1 wherein said hook is remote operated by an acoustic transmitter on said ship and said hook comprises means responsive to a received acoustic signal for opening a catch of the hook, and wherein the step of detaching the hook includes transmitting an acoustic signal from said transmitter to release the catch on the hook.

4. The method of claim 2 wherein said mooring means includes a short pendant line, compared to the depth of the body of water, coupled to the anchor and a submerged buoy attached to the pendant line for maintaining the pendant line erect, and the step of coupling the hook to the mooring means includes attaching the hook to said short pendant line.

5. The method of employing a service ship and anchor-deploying and retrieving equipment for mooring and unmooring to and from the sea bottom a structure floating in a body of water, said structure having mooring means including a mooring line attached to an anchor, said ship being on the surface of said body of water and having a service line, a remote-operated hook attached to the service line, and a control unit on the ship for controlling the operation of the hook;

said method being characterized by utilizing the following steps:

with the service ship near said structure, coupling the hook to said mooring means;

progressively releasing the mooring means from the structure into the body of water;

supporting the mooring means with the service line;

moving the ship away from said structure to a desired location;

progressively lowering the service line through the body of water;

when the anchor reaches the vicinity of said desired location, actuating said control unit to remotely open the hook;

detaching the hook from the mooring means;

burying the anchor in the sea bottom thereby mooring the structure to the mooring means;

taking in the service line onto the ship;

moving the ship near the structure;

submerging the hook and a portion of the service line into the body of water;

towing the submerged hook in a direction intersecting the mooring line until the mooring line is caught inside the hook;

gradually swerving the service line in the direction of the mooring line toward the buried anchor;

progressively releasing the service line as the ship moves toward said desired location and the hook slides down on the mooring line toward the anchor;

uplifting the hook to unseat the anchor from the sea bottom;

progressively taking in the service line into the ship, while supporting the mooring means with the service line;

releasing the hook from the mooring line; and bolstering the anchor on the structure.

6. The method of claim 5 wherein said control unit is an acoustic transmitter and said hook comprises means responsive to a received acoustic signal for opening a catch on the hook, and wherein the step of actuating the control unit includes transmitting an acoustic signal from said transmitter to release the catch on the hook.

7. The method of claim 6 wherein said mooring means further includes a short pendant line, compared to the depth of the body of water, coupled to the anchor, and a submerged buoy for maintaining the pendant line erect, and the step of coupling the hook to the mooring means includes attaching the hook to said short pendant line.

* * * * *